12/27/83 XR 4,422,523

United States Patent [19]

Kuwano

[11] 4,422,523

[45] Dec. 27, 1983

[54] EXHAUST MUFFLER COVER

[75] Inventor: Michiyasu Kuwano, Fushu, Japan

[73] Assignee: Kioritz Corporation, Japan

[21] Appl. No.: 329,088

[22] Filed: Dec. 9, 1981

[51] Int. Cl.[3] ..... F01N 7/00

[52] U.S. Cl. ..... 181/211; 181/243; 181/198; 428/85

[58] Field of Search ..... 181/200, 203, 211, 243, 181/244, 282, 262, 228, 212, 198; 428/85

[56] References Cited

U.S. PATENT DOCUMENTS

| | | | |
|---|---|---|---|
| 3,237,716 | 3/1966 | Parsons | 181/243 |
| 4,073,361 | 2/1978 | Murota et al. | 181/228 |
| 4,265,332 | 5/1981 | Presnall et al. | 181/262 X |
| 4,324,831 | 4/1982 | Parrini et al. | 181/294 X |

*Primary Examiner*—Benjamin R. Fuller

*Attorney, Agent, or Firm*—Karl W. Flocks; A. Fred Starobin

[57] ABSTRACT

An exhaust muffler cover for internal combustion engines having a piled buffering layer provided on the outer surface of a cover member surrounding the exhaust muffler body with a suitable gap therebetween. The cover member has a sufficiently reduced thickness to ensure a good radiation of the heat transmitted from the exhaust muffler body. An attaching member playing the role of a reinforcement is fixed to the inner peripheral end of the cover member.

1 Claim, 1 Drawing Figure

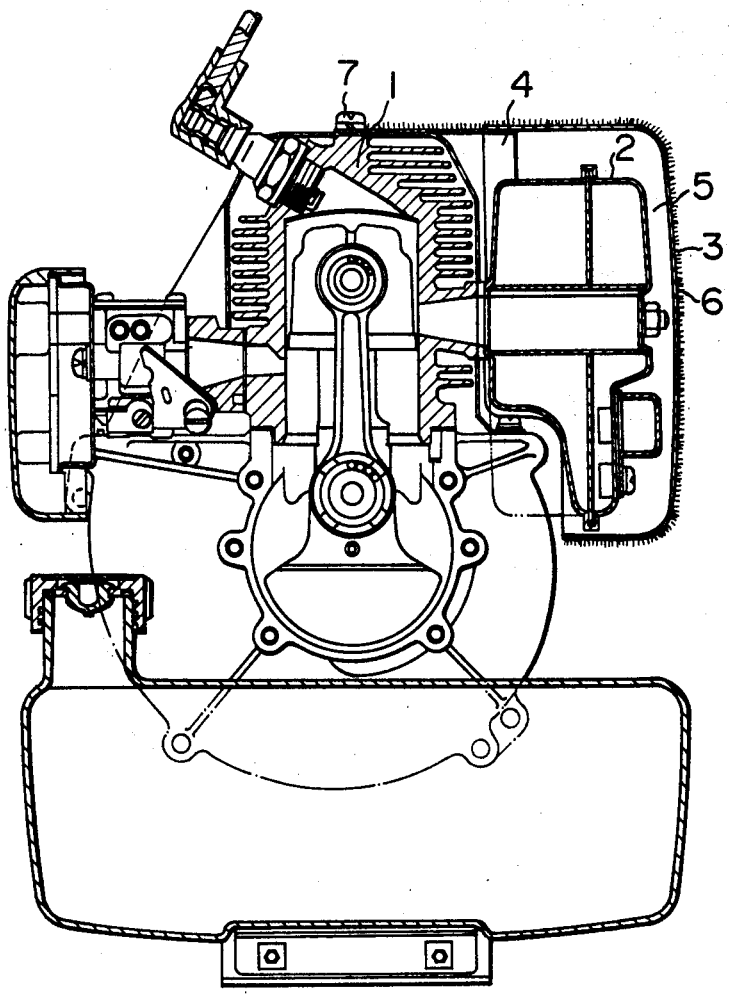
7
1
4
2
5
3
6

EXHAUST MUFFLER COVER

BACKGROUND OF THE INVENTION

The present invention relates to an exhaust muffler cover for covering the exhaust muffler of an internal combustion engine and, more particularly, to an exhaust muffler cover having a piled buffer layer for preventing the operator from getting scorched by contact with the exhaust muffler and for increasing the heat radiation effect.

Generally, the exhaust muffler covers of internal combustion engines are heated to high temperatures by the heat radiated from the exhaust mufflers. In the case where the engine is used outdoors, the muffler cover is heated also by the direct application of the rays of the sun to become hotter.

It is often experienced that the operator of the engine gets scorched at his skin due to a direct contact with the heated exhaust muffler cover.

BRIEF SUMMARY OF THE INVENTION

Accordingly, an object of the invention is to provide an exhaust muffler cover of an internal combustion engine, comprising a cover member coated with a piled buffer layer having a large heat-insulating effect, the portion of the cover member other than the attaching portion having a reduced thickness to provide a larger heat radiation effect, thereby to overcome the above-described problems of the prior art.

The above and other objects, features and advantages of the invention will become clear from the following description of the preferred embodiment taken in conjunction with the accompanying drawings.

BRIEF DESCRIPTION OF THE DRAWINGS

The attached sole FIGURE is a sectional view of an essential part of an exhaust muffler cover constructed in accordance with a preferred embodiment of the invention.

DESCRIPTION OF THE PREFERRED EMBODIMENT

Referring to the FIGURE, an exhaust muffler of the invention has a cover member 3 which covers most part of an exhaust muffler body 2 of an engine 1 with a suitable gap 5 left therebetween. Usually, most part of the muffler cover is projected and exposed to the outside of the engine unit to provide also an attractive appearance of the engine as a commercial goods. This inconveniently increases the chance of contact of the operator's skin, particularly at the hands and arms, with the exhaust muffler cover.

The exhaust muffler body 2 is usually heated to a high temperature of 200° to 300° C. due to a direct contact with the exhaust gas flowing therethrough. The heat is then radiated from the exhaust muffler body 2 to heat the exhaust muffler cover member 3 to a high temperature. Usually, the surface of the exhaust muffler cover member is smoothly finished to provide an attractive appearance. The smoothly finished surface of the exhaust muffler cover provides a condition for heavier burning or scorch of the operator's skin accidentally contacting the exhaust muffler cover member. In addition, it is conceivable that the operator, who has happened to contact the hot exhaust muffler cover, may cause a serious accident due to a reflective action.

These problems of the prior art, however, are effectively avoided by the present invention as will be understood from the following description of the preferred embodiment.

According to the invention, the muffler cover member 3 is coated with a piled buffer layer 6 formed by short fibers of an epoxy resin having lengths ranging between 0.5 and 1.5 m/m and attached perpendicularly to the surface of the muffler cover member 3. The air trapped in the minute space around each pile provides a good heat insulating effect. In addition, the fibers of epoxy resin has only a small heat conductivity. In consequence, the piled buffer layer 6 itself is not heated to high temperature even though the exhaust muffler cover member 3 is heated to a high temperature. Thanks to this heat buffering effect provided by the piled buffer layer 6, the operator does not get scorched even if he accidentally contacts the exhaust muffler cover. In addition, the piled buffer layer 6 provides a soft and comfortable feeling of contact.

According to the invention, the piled buffer layer 6 acts as a heat-insulating layer. It is, therefore, desirable that the heat radiation effect is increased at the opposite side of the muffler cover member 3 to the piled buffer layer 6.

To this end, it is preferred to reduce the thickness of the exhaust muffler cover member 3 as much as possible. In the described embodiment, an attaching member 4 is fixed to the exhaust muffler cover member 3 to extend along the inner peripheral end of the exhaust muffler cover member 3 to play also the role of a stiffener or a reinforcer, while the exhaust muffler cover member 3 itself has a much reduced thickness. The attaching member 4 is secured to the body of the engine 1 by means of screws 7, so that the exhaust muffler cover of the invention, consisting of the cover member 3 coated with the piled buffer layer 6, is secured to the body of the engine 1.

Although the invention has been described through specific terms, the described embodiment is not exclusive and various changes and modifications may be imparted thereto without departing from the scope of the invention which is limited solely by the appended claim.

What is claimed is:

1. A cover for an exhaust muffler for an internal combustion engine comprising an exhaust muffler cover member of a thin material and disposed to substantially surround the exhaust muffler of the engine with a suitable gap therebetween;

said cover member having an outer exposed piled buffering layer consisting of short and soft fibers of an epoxy resin like material having poor heat conductivity, with said fibers being attached perpendicularly to the outer surface of said cover member;

and an attaching member fixed to an inner peripheral end of said cover member and adapted for attaching said cover member to the body of the engine, said attaching member also being a stiffening or reinforcement member.

* * * * *